US005799865A

United States Patent [19]

Gray

[11] Patent Number: 5,799,865

[45] Date of Patent: Sep. 1, 1998

[54] FLAP CLOSURE AND OPENING MEANS FOR ENVELOPES

[75] Inventor: Larry D. Gray, Chesterfield, Va.

[73] Assignee: Westvaco Corporation, New York, N.Y.

[21] Appl. No.: 797,168

[22] Filed: Feb. 10, 1997

[51] Int. Cl.[6] ..... B65D 27/38

[52] U.S. Cl. ..... 229/309; 229/80.5; 229/241; 229/311

[58] Field of Search ..... 229/309, 311, 229/80, 80.5, 241, 313, 314

[56] References Cited

U.S. PATENT DOCUMENTS

| | | | |
|---|---|---|---|
| 2,859,907 | 11/1958 | McFarland | 229/309 |
| 2,926,205 | 11/1960 | McFarland | 229/309 |
| 3,097,784 | 7/1963 | Schaus | 229/238 |
| 4,244,511 | 1/1981 | Coleman | 229/92.1 |
| 4,819,807 | 4/1989 | Giger | 229/313 |
| 5,503,328 | 4/1996 | Roccaforte et al. | 229/313 |
| 5,683,029 | 11/1997 | Lyons | 229/309 |

FOREIGN PATENT DOCUMENTS

| | | | |
|---|---|---|---|
| 774398 | 12/1934 | France | 229/314 |
| 225376 | 5/1943 | Switzerland | 229/313 |
| 23302 | 11/1993 | WIPO | 229/313 |

*Primary Examiner*—Stephen P. Garbe

[57] ABSTRACT

The present invention relates to a paperboard envelope which utilizes a single strip of tear tape having adhesive applied to both sides for sealing and opening. The envelope structure includes starter elements in both the sealing flap and the panel to which the sealing flap is adhered for assisting in the opening function. The improvement lies in extending the starter elements beyond the side edges of the envelope body to provide starter tabs that can be readily grasped to open the envelope.

5 Claims, 1 Drawing Sheet

FLAP CLOSURE AND OPENING MEANS FOR ENVELOPES

BACKGROUND OF INVENTION

The present invention relates generally to envelopes such as mailing envelopes or similar products, made from paper or paperboard, and adapted to be closed and sealed by closure flaps foldably connected thereto. Such envelopes have in the past been closed and sealed by means of a foldable flap having a glue strip. Initially such glue strips were of the type which had to be moistened to effect sealing. Later the glue strips were replaced by a pressure sensitive adhesive which did not require moisture, but which in some cases was initially protected by a protective cover. Opening such envelopes presented a task which often necessitated tearing or cutting of the closure flaps, and in some cases resulted in the inadvertent cutting or tearing of the contents.

To overcome these problems, various means have been suggested to provide more convenient and reliable closing and opening means for such envelopes. For example, in U.S. Pat. No. 2,859,907, there is disclosed an envelope construction having a closure flap 14 which includes a glue strip 26 for sealing the envelope and a separate tear tape 17 for opening the envelope. Meanwhile in U.S. Pat. No. 2,962,205, there is disclosed an envelope flap closure in which the two sided tape 17 that is used to seal the envelope also serves as the means for opening the envelope. The envelope of the '205 patent is opened by separating the tape 17 from the envelope so as to tear the closure flap along a weakened line 24.

Envelope constructions of the type described above do not, however, provide a completely successful solution to the hereinbefore mentioned problems. For example, when the envelope construction is of a material such as paperboard, or a material heavier than the typical paper material used for most envelopes, there is almost an invariable requirement that separate elements be used for sealing and opening the envelope. These elements have in the past included both an application of pressure sensitive adhesive, which is initially covered by a protective strip, and a separate tear tape application spaced from the pressure sensitive adhesive application. This necessity unduly increases both the manufacturing costs and complexity. Therefore, in accordance with the present invention, a combination tear strip/sealing strip has been incorporated into an envelope construction in such a manner that manufacturing costs and manufacturing steps have both been reduced.

It is therefore, an object of the present invention to provide an improved sealing/opening element for a paperboard-type envelope construction which eliminates the need for applying both an adhesive application and a separate tear strip. Other and more specific objects of the invention will become apparent from the following description and the accompanying drawings which illustrate the preferred embodiments of the invention.

SUMMARY OF INVENTION

The envelope construction in accordance with the present invention utilizes a single strip of tear tape for both the closing and opening of the envelope. For this purpose, the tear tape is two-sided, i.e., it has adhesive applied to both sides thereof. One adhesive coated side of the tear tape is preferably applied to an inner surface of the closure flap of the envelope while the other adhesive coated side is protected until use with a removable protective strip. When it is desired to close the envelope, the protective strip is removed and the closure flap is folded over to cover the envelope opening and the exposed adhesive coated surface of the tear tape is sealed to a separate panel of the envelope. The tear tape is preferably stronger than the material from which the envelope is constructed and is sufficiently strong enough that it will tear through the closure flap when the starter tabs at one end of the closure are grasped and pulled in a tearing motion. Meanwhile, the adhesive bond between the tear tape and the separate panel of the envelope is sufficiently strong so that, when the envelope is opened, the tape will separate from the panel and cause a delamination of fiber from the separate panel of the envelope to the tear tape. In accordance with the present invention, the separate panel of the envelope, to which the tear tape is adhered when the envelope is closed, is provided with a starter means which provides assistance in starting the opening process. In addition, the closure flap is also provided with a starter means to make grasping the end of the tear tape to open the envelope more reliable and successful. For this purpose, the starter means in both the closure flap, and the envelope panel to which the closure flap is adhered, are arranged to lie directly over one another, and are bonded with one another when the envelope is closed, and the starter tab created by these starter means is sized so that it extends beyond the side edge of the envelope body to make it more readily available to be grasped when it is desired to open the envelope.

DETAILED DESCRIPTION

Figure 1:
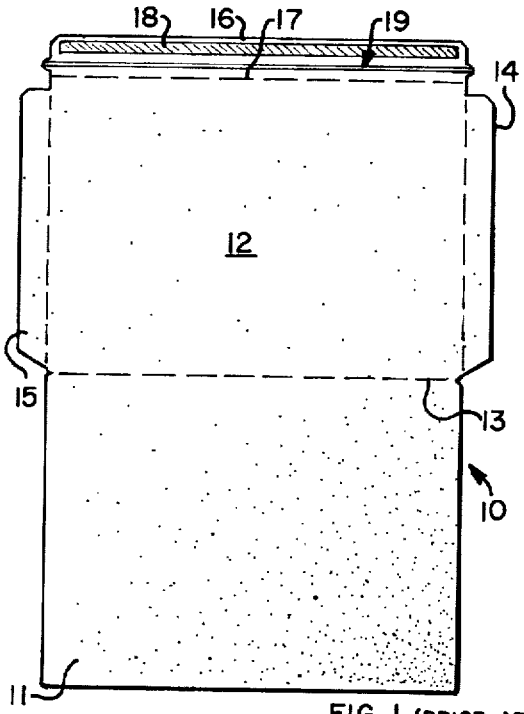
FIG. 1 (PRIOR ART)
FIG. 1 is a plan view of a typical prior art envelope structure of the type disclosed herein.

Referring now to FIG. 1 of the drawing, an envelope blank is illustrated which shows a typical construction used in the past to make envelopes of the type disclosed herein. In such prior art envelopes, both an adhesive strip to close the envelope and a separate tear tape to open the envelope are applied to the blank in two separate steps. Note, for example, in FIG. 1, an envelope blank 10 having a first panel 11 joined to a second panel 12 along a fold line 13. Panel 12 also includes side flaps 14, 15 foldably attached to the side edges thereof and a closure flap 16 foldably attached to the upper edge thereof along a fold line 17. In the prior art example shown, the closure flap 16 includes a first adhesive application 18 located along the free edge thereof and a strip of tear tape 19 positioned between the adhesive application 18 and the fold line 17. After the envelope is formed from blank 10, it is closed by adhering the adhesive strip 18 to the panel 11. When it is desired to open the envelope, the tear tape 19 is pulled in a tearing motion to separate the closure flap from panel 11. This arrangement, as pointed out before, requires the application of two elements, (adhesive strip 18 and tear tape 19), in two steps, which is neither expedient from a manufacturing viewpoint or cost effective from an economic viewpoint. These deficiencies are overcome with the envelope construction described hereinafter.

Figure 2:
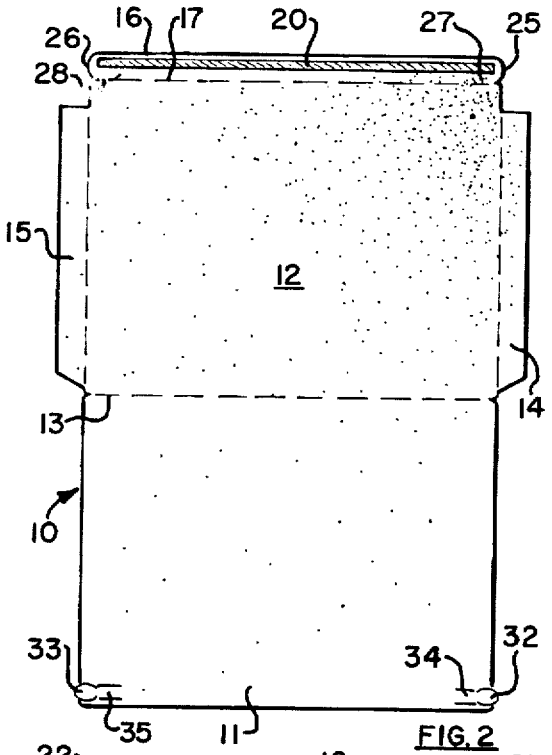
FIG. 2 is a plan view of a first embodiment of the envelope structure of the present invention.

Referring now to FIG. 2, there is illustrated a first embodiment of the envelope structure of the present invention. The blank structure 10 shown in FIG. 2 is substantially the same as the structure illustrated in FIG. 1, with a pair of outer panels 11, 12 joined along fold line 13, side closure flaps 14 and 15, and a top closure flap 16. However, as will be readily apparent from a comparison of FIGS. 1 and 2, the improved structure shown in FIG. 2 utilizes only a single strip of tear tape 20, having adhesive on both surfaces, applied to closure flap 16 for the purpose of both closing the envelope and opening the envelope. In addition, it will also be seen in FIG. 2 that panel 11 includes a pair of starter elements 32, 33 one located at each side edge thereof, which are adapted to cooperate with starter elements 25, 26 formed in flap 16 for initiating the tearing of panel 16 when the envelope is opened. Each starter element 32, 33 and 25, 26 consists of shaped portions of the panel material and the closure flap material which extend beyond the outside edges thereof. The starter elements are preferably formed by cut lines that include nick elements (as are well known to those skilled in the art), for keeping the shaped portions initially in place. The starter elements 32, 33 include narrow strips of panel material formed by substantially parallel, spaced apart cut lines, which extend inboard from the edges of the panel 11 a short distance. The narrow strips 34, 35 are preferably of about the same width as the tear tape 20, and the tear tape is adhered thereto when the envelope is closed. Meanwhile starter elements 25, 26 in closure flap 16 are formed by starter cuts 27, 28 which lie substantially along the fold line 17, and they too extend inboard from the free ends of flap 16 a short distance. The narrow strips 34, 35 of starter elements 32, 33 are applied to panel 11 in a location such that they will lie substantially directly under the tear tape 20 when the flap 16 is folded over about fold line 17 to close the envelope. Likewise, starter elements 25, 26 are arranged to lie directly over starter elements 32, 33 respectively, when the envelope is closed. Subsequently, when it is desired to open the envelope, either end of the closure flap 16 which now has starter tabs formed by starter elements 25, 32 at one side and starter elements 26, 33 at the other side, may be grasped for initiating opening of the envelope. Upon lifting the combined starter elements, or the starter tab at one side, the nicks which were previously holding the starter element 32 or 33 within the plane of panel 11 in place are broken and the starter element 32 or 33 is separated from panel 11. Any subsequent tearing action from left-to-right or right-to-left causes the tear tape 20 to tear through the closure flap 16, and at the same time, the strong bond between the tear tape 20 and the panel 11 causes a fiber separation/delamination of the remainder of the panel material to the tear tape 20 to open the envelope.

Figure 3:
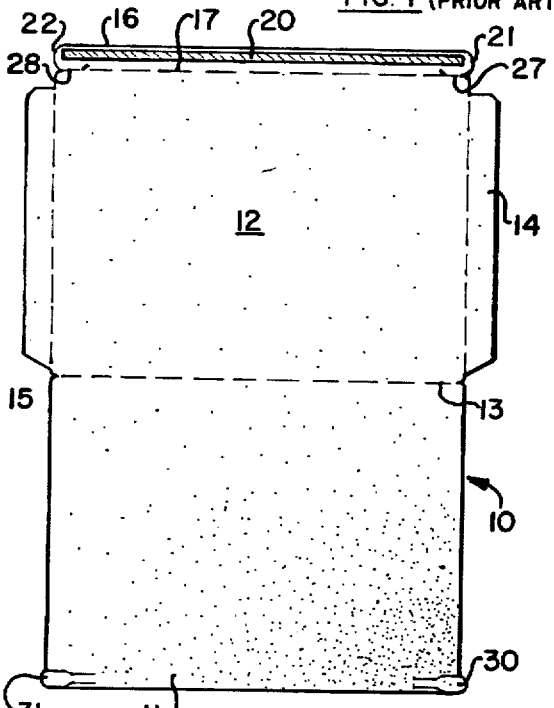
FIG. 3 is a plan view of a second embodiment of the envelope structure of the present invention.
Figure 4:
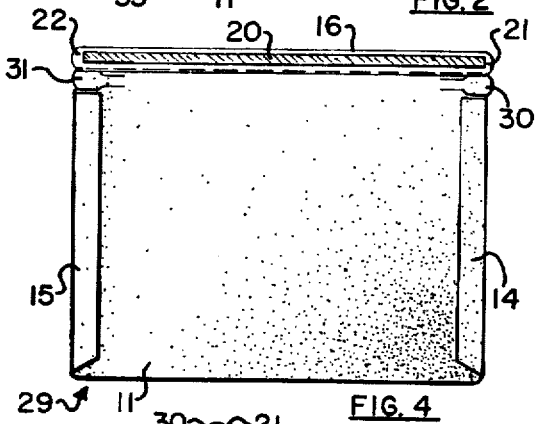
FIG. 4 is a plan view of the envelope of FIG. 3 formed and ready to receive its contents.
Figure 5:
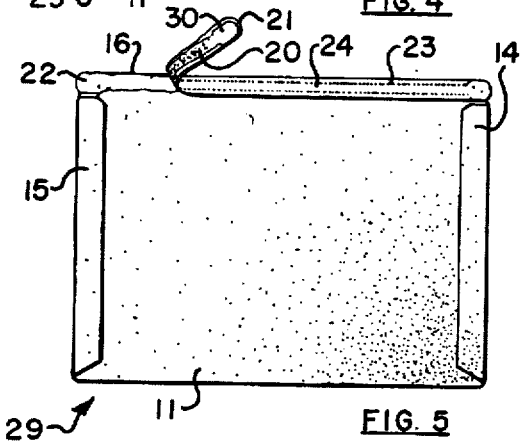
FIG. 5 is a plan view of the envelope of FIG. 4 partially opened.

FIG. 3 illustrates a second embodiment of the envelope of the present invention wherein the starter elements 30, 31 are located at the outer ends of panel 11. As shown in FIG. 3, the starter elements 30 and 31 are located at the extreme outer ends of panel 11 and comprise elongated tabs which are partially cut from the envelope blank material. Each of the starter elements 30, 31 preferably is formed with an enlarged portion at the extreme edges of the blank which are integrally connected to adjacent narrow strips substantially as shown in FIG. 2, which extend inboard from the edges of the blank. In addition as disclosed in connection with the first embodiment, starter cuts 27, 28 are also located at each end of the closure flap 16 to provide matching starter elements 21, 22. Thus, as explained hereinbefore, the starter elements 30, 31 of FIG. 4 when bonded to the starter elements 21, 22 in closure flap 16, together form starter tabs which are designed to provide means for easily lifting the tear strip 20 from the panel 11 and severing the closure flap 16 when the envelope is to be opened. As in the case of the first embodiment, the envelope is opened with a neat and controlled delamination of the tear strip 20 from panel 11. FIG. 5 illustrates a typical example of the envelope structure of the present invention showing the opening step. Note that the tear strip 20 severs the closure flap 16 along a substantially clean line 23 while the tear strip 20 creates a fiber tear/delamination area 24 in the panel 11 as it is removed.

Summarizing the invention, it may be seen that the embodiments shown and described herein illustrate an envelope structure wherein only a single application of tear tape may be used for both the sealing and opening functions. The improvements contemplated by the present invention include the addition of starter elements in both the closure flap and the panel of the envelope structure to which the closure flap is adhered for assisting with the opening function. In each case, the improvement contemplated herein is to extend the starter elements at each side of the envelope beyond the side edges of the envelope to provide starter tabs with a double thickness of starter material that are readily available to be grasped for initiating a reliable opening. Accordingly, although the invention has been disclosed in particular for mailing envelops of the overnight type, the features of the invention could be applied to other types of packages wherein one flap or panel is to be folded and sealed against another flap or panel.

What is claimed is:

1. In a paperboard envelope having a body including front and rear panels and side flaps, a closure flap hingedly connected to one of said panels which is adapted to be folded over and sealed to the other of said panels, said closure flap having a straight edge opposite its hinge connection which extends across the width of the flap and terminates at the two side edges of the envelope body, a single means for both sealing the closure flap to the envelope body and for releasing the closure flap from the envelope body, said means comprising an elongated strip of tear tape that is stronger than the material from which the envelope is constructed having adhesive on both surfaces, one surface of which is bonded to the inside face of the closure flap adjacent to the straight edge thereof and the other surface of which is adapted to be adhered to the envelope body for closing the envelope, at least one starter element cut from an envelope panel at a side edge thereof which lies beneath the closure flap and extends beyond the side edge of the envelope body, and a complimentary starter element formed at a side edge of the closure flap which also extends beyond the side edge of the envelope body, wherein said starter elements are adapted to be bonded together by said tear tape when the envelope is closed to form a starter tab which extends beyond the side edge of the envelope body for initiating the opening of the envelope, said tear tape serving to tear through the closure flap and produce a fiber separation/delamination of the envelope body material to the tear tape when the envelope is opened.

2. The envelope of claim 1 wherein the other surface of the tear tape is covered by a protective strip until such time that it is desired to be adhered to the envelope body.

3. The envelope of claim 2 wherein starter elements are formed in the opposed side edges of the envelope panel and the closure flap in substantial alignment at each side of the envelope body.

4. The envelope of claim 3 wherein the starter elements formed in the envelope panel comprise similarly shaped portions of material cut from the envelope panel.

5. The envelope of claim 4 wherein the starter elements formed in the closure flap comprise similarly shaped portions of material cut from the closure flap.

* * * * *